US010342999B2

(12) United States Patent
Song et al.

(10) Patent No.: US 10,342,999 B2
(45) Date of Patent: Jul. 9, 2019

(54) PARTICULATE FILTER FACE MASK HAVING FAN BREATHING ASSIST

(71) Applicants: Yang Song, Issaquah, WA (US); Luke Song, Issaquah, WA (US)

(72) Inventors: Yang Song, Issaquah, WA (US); Luke Song, Issaquah, WA (US)

( * ) Notice: Subject to any disclaimer, the term of this patent is extended or adjusted under 35 U.S.C. 154(b) by 0 days.

(21) Appl. No.: 15/743,420

(22) PCT Filed: Jul. 15, 2016

(86) PCT No.: PCT/US2016/042479
§ 371 (c)(1),
(2) Date: Jan. 10, 2018

(87) PCT Pub. No.: WO2017/065853
PCT Pub. Date: Apr. 20, 2017

(65) Prior Publication Data

US 2018/0236275 A1 Aug. 23, 2018

Related U.S. Application Data

(60) Provisional application No. 62/242,852, filed on Oct. 16, 2015.

(51) Int. Cl.
*A62B 18/00* (2006.01)
*A62B 18/02* (2006.01)
(Continued)

(52) U.S. Cl.
CPC ..... *A62B 18/006* (2013.01); *A62B 18/025* (2013.01); *A62B 18/10* (2013.01); *A62B 23/02* (2013.01)

(58) Field of Classification Search
CPC ..... A62B 18/006; A62B 18/08; A62B 18/00; A62B 18/003; A62B 18/02; A62B 18/025;
(Continued)

(56) References Cited

U.S. PATENT DOCUMENTS 1,319,273 A * 10/1919 Dobey ..... A62B 23/025 128/206.16
2,744,523 A * 5/1956 Malcom, Jr. ..... A62B 23/02 128/206.17
(Continued)

FOREIGN PATENT DOCUMENTS

EP 1645309 B1 10/2005
WO 2014035641 A2 3/2014

*Primary Examiner* — Gregory A Anderson
*Assistant Examiner* — Victoria Murphy
(74) *Attorney, Agent, or Firm* — Timothy E. Siegel Patent Law, PLLC; Timothy E. Siegel

(57) ABSTRACT

A respiratory mask assembly (10), adapted to be placed over the nose and mouth of the face of a wearer. The mask assembly includes a base mask (12), defining a set of openings; a filter (30), detachably supported by the base mask and covering the openings; and a source of electricity (60). Also, an air exit valve (34) is positioned over one of the openings of the base mask and releases air from inside the mask to the outside when pressure inside is greater than air pressure outside. Finally, a centrifugal fan (22) is electrically connected to the source of electricity and is positioned in one of the openings of the base mask so as to draw air through the filter to the inside. This fan blows air into the inside in a direction that misses the wearer's face.

9 Claims, 6 Drawing Sheets

(51) Int. Cl.
*A62B 18/10* (2006.01)
*A62B 23/02* (2006.01)

(58) Field of Classification Search
CPC ..... A62B 23/00; A62B 23/02; A62B 18/10; A62B 23/025; F04D 27/004; A61M 16/0066; A61M 16/0069; A41D 13/11
See application file for complete search history.

(56) References Cited

U.S. PATENT DOCUMENTS 2,845,926 A * 8/1958 Hill ..... A62B 23/025 128/206.17
2,845,927 A * 8/1958 Hill ..... A62B 23/025 128/206.17
3,154,073 A * 10/1964 Klinger ..... A41D 13/11 128/206.12
3,521,630 A * 7/1970 Westberg ..... A62B 23/025 128/206.15
4,090,510 A * 5/1978 Segersten ..... A41D 13/11 128/206.12
4,590,951 A * 5/1986 O'Connor ..... A62B 18/006 128/201.25
4,630,604 A * 12/1986 Montesi ..... A62B 18/025 128/206.15
4,838,262 A 6/1989 Katz
4,856,508 A * 8/1989 Tayebi ..... A62B 23/025 128/206.12
4,886,056 A * 12/1989 Simpson ..... A62B 18/006 128/201.25
4,981,134 A * 1/1991 Courtney ..... A62B 18/025 128/206.15
5,010,594 A * 4/1991 Suzuki ..... A61M 16/1045 128/201.13
5,062,421 A * 11/1991 Burns ..... A62B 18/025 128/205.27
5,113,853 A * 5/1992 Dickey ..... A62B 18/045 128/200.28
5,372,130 A * 12/1994 Stern ..... A62B 18/006 128/205.25
5,689,833 A * 11/1997 Allen ..... A62B 18/08 128/201.15
6,298,849 B1 * 10/2001 Scholey ..... A62B 7/10 128/205.27
D467,656 S * 12/2002 Mittelstadt ..... D24/110.1
D471,627 S * 3/2003 Mittelstadt ..... D24/110.1
6,817,362 B2 * 11/2004 Gelinas ..... A62B 18/025 128/206.12
7,028,688 B1 * 4/2006 Grove ..... A62B 17/04 128/201.22
7,114,496 B1 * 10/2006 Resnick ..... A62B 23/02 128/201.25
7,195,015 B2 * 3/2007 Kuriyama ..... A62B 18/006 128/204.21
7,686,018 B2 3/2010 Cerbini
8,667,959 B2 3/2014 Tilley et al.
9,827,723 B2 * 11/2017 Klockseth ..... A62B 18/02
2003/0015201 A1 * 1/2003 Bostock ..... A41D 13/1115 128/206.21
2003/0066527 A1 * 4/2003 Chen ..... A62B 18/006 128/204.18
2003/0188743 A1 * 10/2003 Manne ..... A62B 18/003 128/201.22
2005/0011516 A1 * 1/2005 Lukas ..... A62B 18/006 128/201.22
2005/0061327 A1 * 3/2005 Martin ..... A62B 18/10 128/206.15
2005/0109343 A1 * 5/2005 Flanningan ..... B29C 45/0062 128/206.17
2006/0130834 A1 * 6/2006 Chen ..... A62B 18/006 128/204.21
2007/0131228 A1 * 6/2007 Croll ..... A62B 18/006 128/204.15
2007/0163586 A1 * 7/2007 Burnett ..... A62B 18/003 128/204.18
2007/0221214 A1 * 9/2007 Brockman ..... A62B 17/04 128/201.25
2007/0240716 A1 * 10/2007 Marx ..... A62B 18/006 128/204.21
2010/0294274 A1 * 11/2010 Poirier ..... A62B 18/088 128/202.22
2011/0126713 A1 * 6/2011 Legare ..... A62B 23/02 96/135
2012/0174922 A1 * 7/2012 Virr ..... A61M 16/0066 128/203.12
2013/0139823 A1 * 6/2013 Lee ..... A62B 18/02 128/206.19
2015/0151147 A1 * 6/2015 Fun ..... A62B 18/006 128/206.17

* cited by examiner

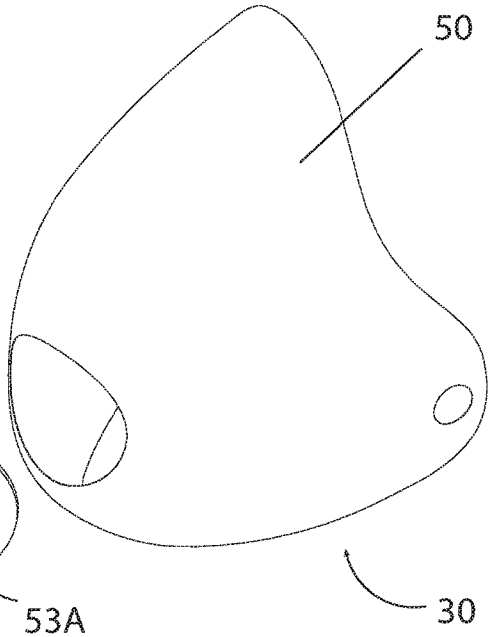
FIG. 4
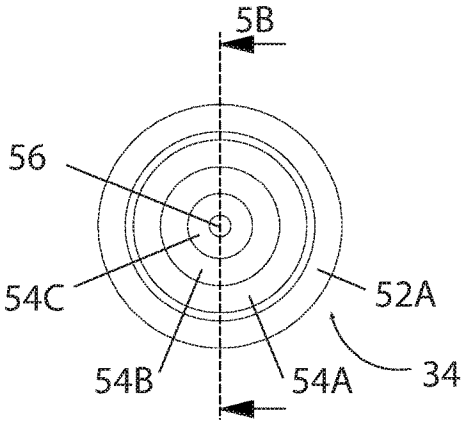
FIG. 5A
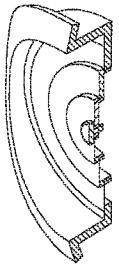
FIG. 5B
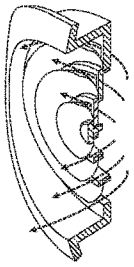
FIG. 5C
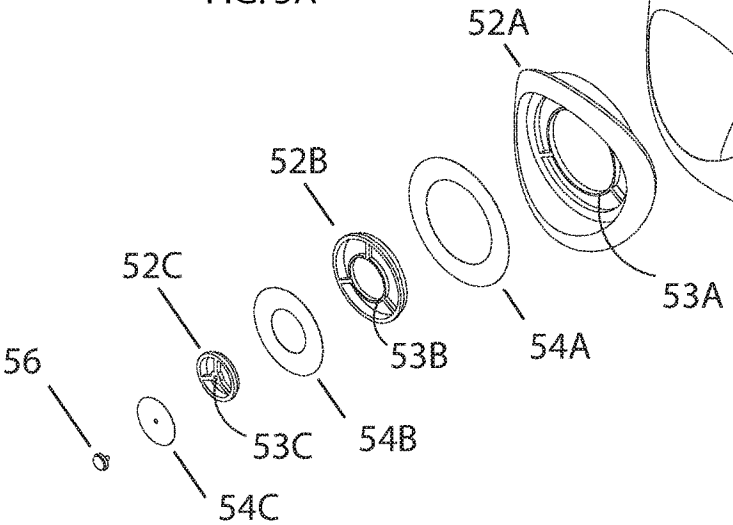

FIG. 9
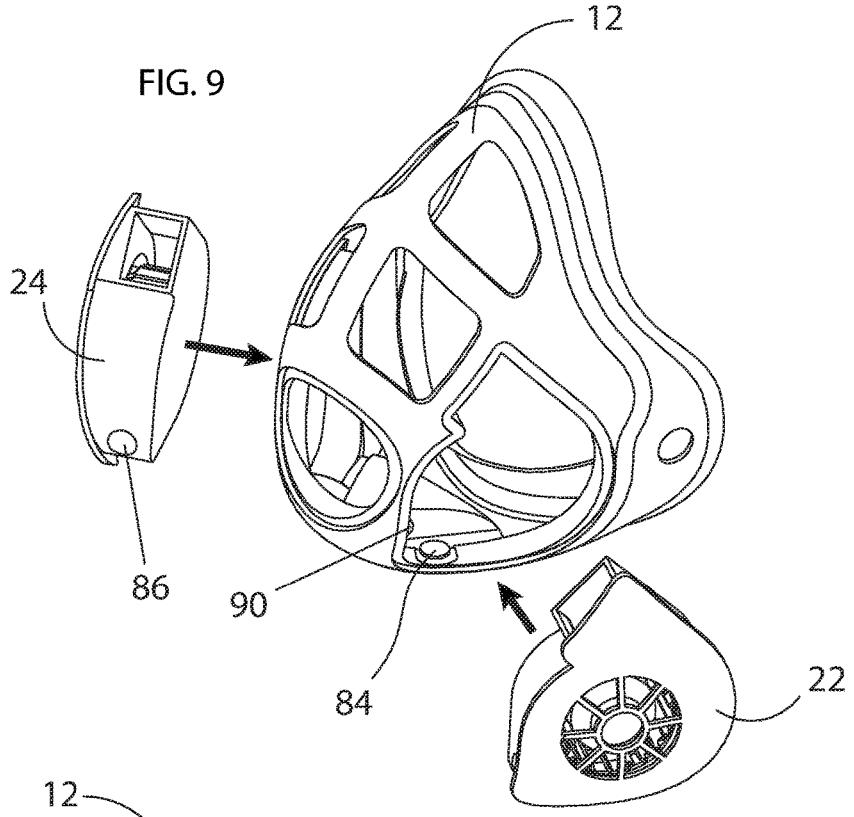
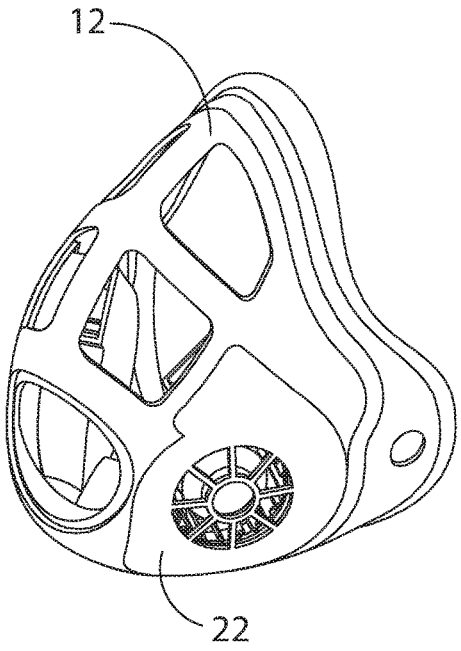
FIG. 10

PARTICULATE FILTER FACE MASK HAVING FAN BREATHING ASSIST

FIELD OF THE INVENTION

The invention is in the field of particulate filtering masks having increased comfort.

BACKGROUND ART

There are many reasons a person might wish to wear a face mask that filters particulates from the air that is breathed. In an area having high air pollution this is desirable, simply to protect the respiratory and cardiovascular systems of the face mask wearer. Further there are many work situations, for example concrete sawing, or removing old paint with a sander, where encountering air filled with particulates is inevitable. With the familiar disposable face mask, the wearer must draw in air sufficiently to go through the face mask. For the young and the elderly, this may be difficult. Additionally, familiar disposable face masks often suffer from a lack of air ventilation, which can cause discomfort as excessive heat and moisture to build up.

There are many difficult trade-offs in the design of a particulate filter face mask. The smallest particles, those below 25 micrometers in size, pose the greatest threat to human health, as they may enter the smallest portion of the alveoli and may even enter the blood stream. Yet a filter that can filter out such tiny particle will offer a greater resistance to air flow, potentially making breathing difficult, and will tend to clog up faster, requiring more frequent changes of filter material.

Even for face masks equipped with motorized air-supply systems, the fan and power supply units are often too bulky and heavy to be comfortable and mobile. Although a number of face masks have been proposed having integrated portable fan assist in order to achieve comfort, mobility and higher filtration efficiency, none of them appear to have met with great commercial success. One issue is the difficulty of having a fan push all of the required air through a filter. A normal adult draws an in-breath about 12 times per minute. Each inhale takes about 0.5 litter (0.018 cubic feet) of air, which translates to a total of about 6 liters per minute (0.21 cubic foot per minute [CFM]). On average, a human can breathe 12 to 35 times per minutes and take in average 0.5 liter to 6 liter air per inhale resulting in a rate of 0.5 CFM to 6 CFM. This drives a requirement for a large, heavy fan that tends to weigh down a wearer, and may even create a rather loud sound that may be unwelcome to the user.

Unfortunately, wearing currently available masks can be uncomfortable or ineffective. The simple, commonly available disposable masks tend to leave a space between the mask boundary and the face, thereby potentially permitting particulates to enter the mask wearer's airways. Forming a seal between the mask and the wearer's face, however, risks a loss of comfort. The great variety of facial shapes makes a particular challenge of finding a mask structure that adequately serve the broad range of the public.

Another issue with having a currently available mask with a fan is that fan replacement, either in the event of a broken fan, or to exchange a current fan for one with different characteristics, can be quite difficult. Also, the currently available design in which a filter fits about an air valve risks cross contamination when the filter is exchanged. Further, fans permanently set into a face mask according to currently available designs also risk cross-contamination and are a challenge to clean and sterilize.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate the present invention may take the form of a particulate filtering mask assembly, adapted to be placed over the nose and mouth of the face of a wearer and defining an inside space between the mask and the wearer and an outside space, separated by the mask from the inside space. The mask assembly includes a base mask, defining a set of openings; a filter, detachably supported by the base mask and covering the openings; and a source of electricity. Also, an air exit valve is positioned over one of the openings of the base mask and releases air from the inside space to the outside space when pressure in the inside space is greater than air pressure in the outside space. Finally, a centrifugal fan is electrically connected to the source of electricity and is positioned in one of the openings of the base mask so as to draw air through the filter to the inside space. This fan blows air into the inside space in a direction that misses the wearer's face.

In a second separate the present invention may take the form of a method of facilitating users of respiratory, particulate filtering masks for a population of users having varying facial characteristics that utilizes mask assemblies, each including at least a base mask and a filter sized and shaped to fit over the base mask. In the method base mask face liners are provided according to at least a first design and a second design, the first design being adapted to fit a face having a first set of facial characteristics and the second design being sized and shaped to fit a face having a second set of facial characteristics.

In a third separate the present invention may take the form of a particulate filtering mask assembly, including a base mask having a rim; a filter, sized and shaped to fit over the base mask; and a face liner, sized and shaped to fit on the rim and to be interposed between the rim and users' face when the mask is worn.

In a fourth separate the present invention may take the form of a particulate filtering mask assembly having a nose-facing side defining an interior space and an outside-facing side, including a base mask defining a set of openings. A filter is sized and shaped to fit over the base mask and has particulate filter material and an integral air valve, positioned to align to one of the openings of the base mask. The air valve is attached to the particulate filter material and oriented to let air out from the interior space when air pressure inside the interior space exceeds air pressure outside the mask assembly and to block air from entering the interior space, otherwise.

In a fifth separate the present invention may take the form of an air valve, permitting air to flow from a first side to a second side, including a valve seat, defining a first opening. A first flexible flap element is positioned on the second side of the valve seat, at the first opening and being larger than the first opening, and anchored to the valve seat through a set of tension members, the first flexible flap element defining a second opening. Also, a second flexible flap element is positioned on the second side of the first flexible flap element, at the second opening and being larger than the second opening, and anchored to the first flexible flap element through a set of tension members. Accordingly, air pressing against the air valve from the first side causes the first flexible flap element to separate from the valve seat and the second flexible flap element to separate from the first flexible flap element, wherein air may pass between the elements from the first side to the second side.

In a sixth separate the present invention may take the form of a particulate filtering mask assembly, including a base mask defining an opening, and having a battery contact and a mask electrical contact point at the opening, the mask electrical contact electrically connected to the battery contact. Also, a filter is sized and shaped to fit over the base mask; and an electric fan is removable and matingly set into the opening, the electric fan including a fan electrical contact, contacting the mask electrical contact.

In a seventh separate the present invention may take the form of a particulate filtering mask assembly, adapted to be placed over the nose and mouth of the face of a wearer and defining an inside space between the mask and the wearer and an outside space, separated by the mask from the inside space, and including a base mask, having an open side facing the wearer's face, a bottom wall and a curved side wall. A filter is detachably supported by the base mask and covering the opening and at least one fan is positioned on the base mask so as to draw air through the filter to the inside space. Also, an air exit valve releases air from the inside space to the outside space when pressure in the inside space is greater than air pressure in the outside space; and a battery port is positioned on the bottom wall, and conductors connect the battery port to the at least one fan.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

FIG. 4 is an isometric of a filter and exhale valve assembly for use in the assembly of FIG. 1, with the exhale valve shown in exploded view.

FIG. 5A is a front view of the exhale valve of FIG. 4.

FIG. 5B is a section view of the exhale valve of FIG. 4, with the view slightly rotated and the section taken along line 5B-5B.

FIG. 5C is view identical to that of FIG. 5B, but showing the valve during exhale when air is passing through it.

FIG. 9 is an isometric view of the base mask and fans of the assembly of FIG. 1, showing the fans removed.

FIG. 10 is the same view as FIG. 9, with the fans installed.

PREFERRED MODES OF CARRYING OUT THE INVENTION

Figure 1:
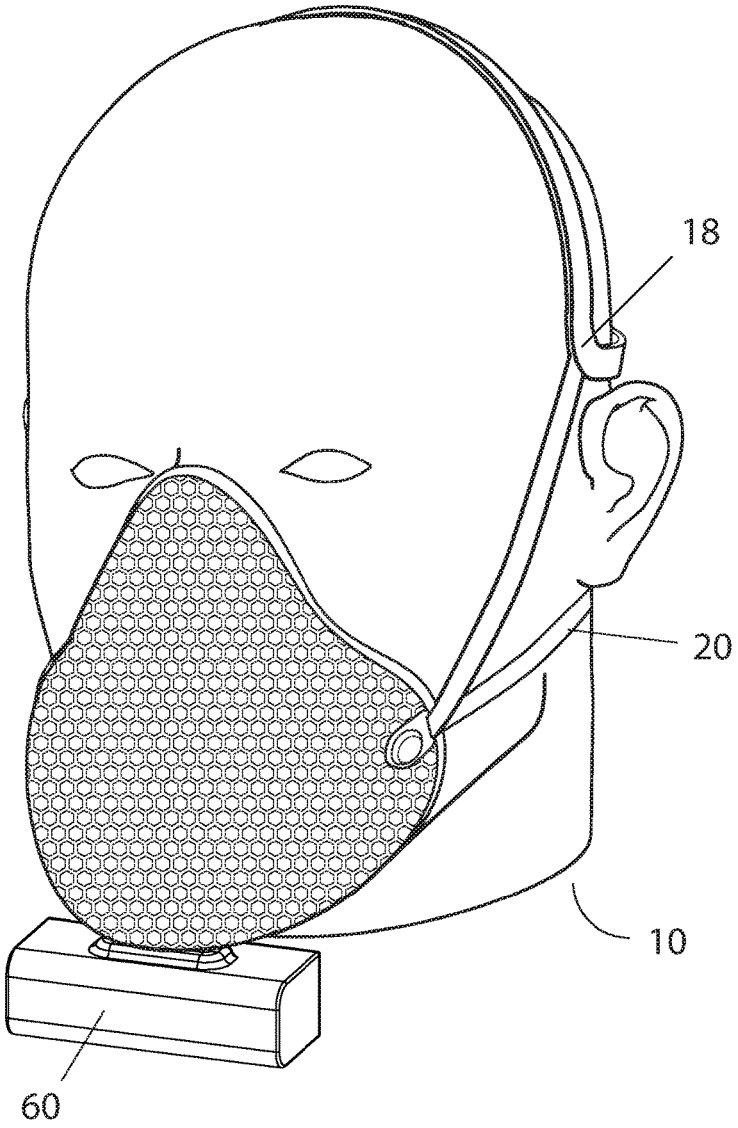
FIG. 1 is a perspective view of a particulate filter mask assembly, according to the present invention, being held in place over a portion of the face of a user.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figures 2, 3:
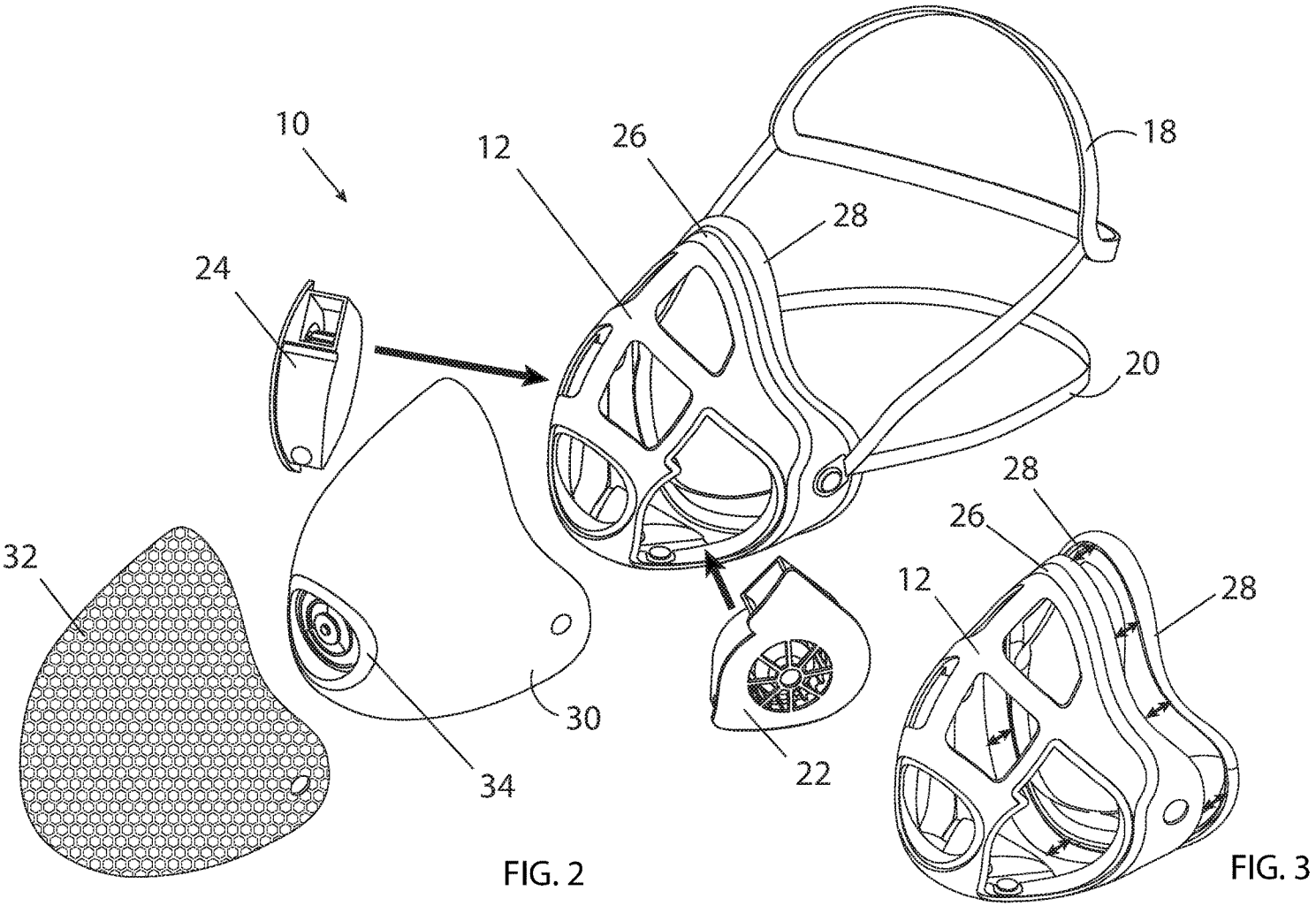
FIG. 2 is an isometric view of the mask assembly of FIG. 1, in a disassembled state.
FIG. 3 is detail view of the base mask and liner of the mask assembly of FIG. 2, shown separated from each other.

Referring to FIGS. 1 and 2, the face mask 10 includes a base mask 12, a conformal filter 30 and a mask cover 32, as well as a head strap 18, neck strap 20, and battery box 60 (FIGS. 1 and 2). The base mask 12 is a contour grill or mesh structure with two openings on the sides to support a wearer's left side centrifugal fan 22 and a right side centrifugal fan 24 (FIG. 2). Each centrifugal fan 22 and 24 is a 12-voltage direct current electrical powered high flow and high efficiency fan having dimensions of about 50 mm×50 mm×23 mm.

On top of the base mask 12, a conformal filter 30 is positioned, which is in turn held in place by an air permeable filter cover 32. Conformal filter 30 includes a one-way exhale valve 34 which is about 35 mm in diameter (FIG. 2). In other embodiments filter 30 is held in place by a rim clamp or by adhesive.

The base mask 12, conformal filter 30 and mask cover 32 are all shaped, very generally as curved tetrahedrons, with an open side facing the wearer's face, a bottom face or wall, and two side faces or walls that meet at a curved upper edge and join to each other and bottom face at an apex, where exhale valve 34 is located on the filter 30. The curve of the mask cover 32 is integrated with the curve of the base mask 12 nose line and stretches smoothly down to the chin area of the base mask. Centrifugal fans 22 and 24 are configured and positioned to pull air through filter 30 and the direct it upward and forward, away from a mask wearer's face, and toward the curved upper edge of the base mask 12, to avoid irritating the wearer.

Left side fan 22 draws air in and spins this air counterclockwise. Right side fan 24 draws air in and spins this air clockwise, also releasing this air toward the upper centerline inside base mask 12 and thereby avoiding the wearer's face, nose and mouth. The use of centrifugal fans 22 and 24, as opposed to any different type of fans, permits this feature of redirecting the air flow by 90 degrees, so that fan exhaust outputs air upwardly to avoid an irritating stream of air contacting sensitive facial features. In a preferred embodiment, each fan is tuned to reach 13,000 rpm with 12 VDC power and a current of 0.3 Amps. A fuse and heat sensor in fan units 22 and 24 prevent fans from a power surge and damage from a short circuit and an electronic control unit protects the fans 22 and 24 from damage in the event of a jammed rotor. Also, protection bars at the fan inlets and outlets prevent damage from facial hair or other foreign objects. In addition, a fuse and voltage and control current chips are also located in the base mask 12 and battery unit 60, provide further protection.

The mask cover 32 follows the same shape and contour of base mask 12. Mask cover 32 is latched onto base mask 12 with conformal filter 30 interposed between the two. This design maximizes the air filtration and heat exchange areas of the face mask 10, increasing air filter efficiency and reducing moisture build up. In preferred embodiments filter 30 filters meets any one of the NIOSH N95, N99, N100, P95, P99 or P100 standards.

Base mask 12 defines a rim 26, over which is fit a face liner 28, which in a preferred embodiment is made of silicone and has a resilient deformability that increases the comfort of the person wearing mask assembly 10 and creates a better seal between mask assembly 10 and the wearer's face (FIGS. 2 and 3). In a preferred embodiment a set of face liners 28 is made available, having differing physical characteristics, each liner design adapted to fit over a face having specific physical characteristics.

Figure 7:
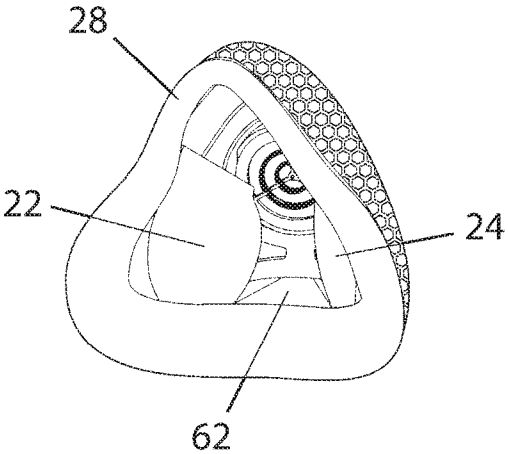
FIG. 7 is a rear isometric view of the filter mask assembly of FIG. 1.
Figure 6:
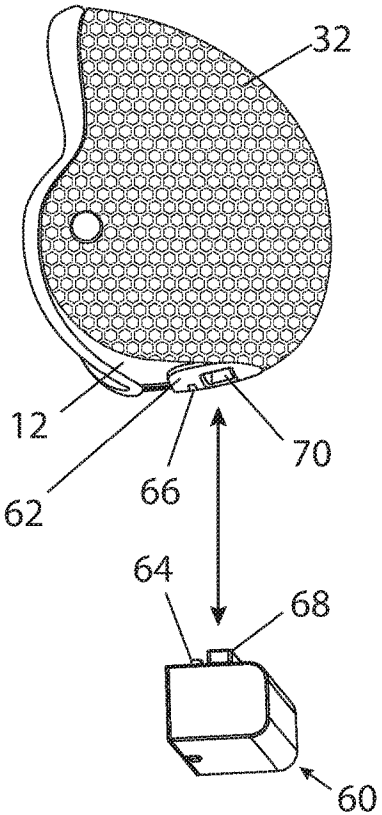
FIG. 6 is a bottom-side isometric view of the filter mask assembly of FIG. 1, showing the battery attachment features.
Figure 11:
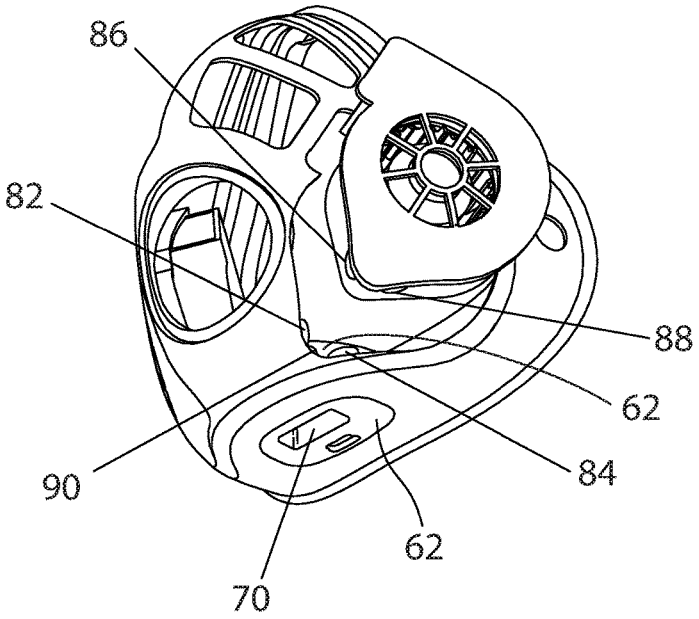
FIG. 11 is an isometric view of the base mask and a fan, the view being rotated to show the bottom of the base mask.
Figure 12:
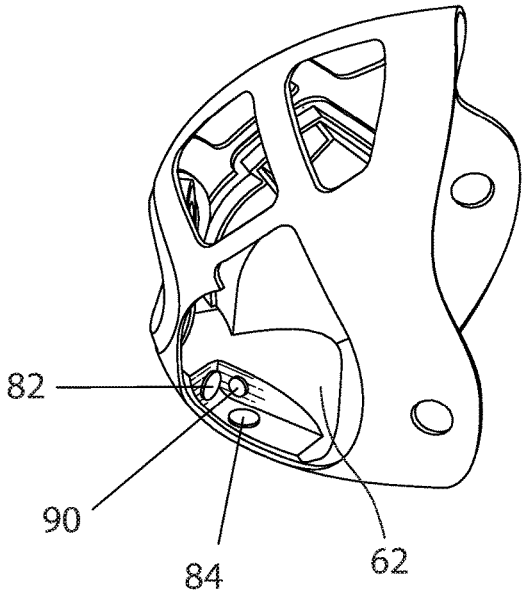
FIG. 12 is an isometric view of the base mask, rotated to show the fan contact pads and the on/off switch.

The conformal filter 30 is a pre-cut nonwoven fabric filter material having an exhale valve 34, which prevents that cross-contamination which might otherwise occur when a filter is changed and the mask assembly 10 is provided to another user. Also, filter 30 is shaped with a concave edge at the bottom, to permit a USB and battery box attachment unit 62 on base mask 12 to remain uncovered when the filter 30 is in place (FIGS. 6 and 7). The conformal filter 30 may be replaced by an alternative conformal filter (not shown), having different air filtering characteristics, so that a variety of air filtering requirements may be met. For example, different filters are provided for light pollution, as opposed to heavy pollution days, and for the particular types of particulates encountered in varying work environments. A filter is provided that is optimized for filtering pollen, for those working around plants, such as farmers and gardeners.

Referring to FIGS. 4, 5A, 5B and 5C, exhale valve 34 is composed of a valve seat 52*a*, which is welded to the filter material portion 50 of filter 30. A ring portion 53*a* of seat 52*a* supports an air tight, flexible flap ring 54*a*. Also, an inner structure 52*b* (including members that may be held in tension) is supported by ring portion 53*b* and in turn supports an intermediate flap ring 54*b* and an innermost structure 52*c*. Structure 52*c* supports final disk flap 54*c* and a pin 56, which holds disk flap 54*c* in place. In other embodiments fewer or more flap rings may be employed, as air flow requirements may dictate. As shown in FIG. 5C, on the outbreath air causes the flaps 54*a*, 54*b* and 54*c* to blow outwardly as shown, permitting air to pass. But as is shown in FIG. 5B, otherwise flaps 54*a*, 54*b* and 54*c* lay flat, blocking air that might otherwise flow inwardly. Accordingly air may flow outwardly from the interior of filter through exhale valve 34, avoiding any filter material 50 and the attendant resistance to air flow, but cannot avoid filter material 50 on the in-breath. In additional preferred embodiment, additional concentric flap rings may be added to the structure.

Figure 8:
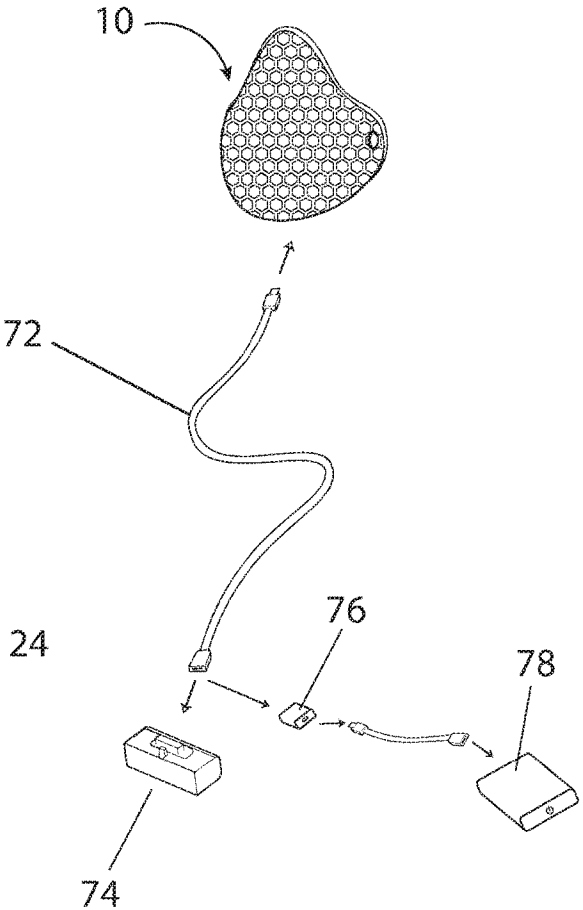
FIG. 8 is an illustration of cable attachments to the assembly of FIG. 1.

Referring to FIGS. 6 and 7 a battery 60 attaches to inner mask 12 by a battery attachment unit 62, with a USB plug 64 being introduced into a USB receptacle 66. Also, a protruding magnet 68 (a magnetic support) fits into a magnet receiver 70, to prevent the weight of the battery 60 from causing a detachment. Referring to FIG. 8, a USB cord 72 may be used to connect port 66 with now detached battery 60, which may be carried in a user's pocket, for example, thereby requiring less weight to be carried on the face, but possibly reducing the freedom of movement of the user. If more time is desired for operating fans 22 and 24, a larger alternative battery 78 may be used. One form of a larger battery that is currently in widespread use is referred to as a "power bank," which is in widespread distribution and generally used for recharging a mobile device. As a power bank is a 5.1 Volt battery and as in a preferred embodiment battery 60 is a 12 volt battery, if a power bank is used as larger battery 78, a transformer 76 must be interposed to provide 12 volt power.

Referring to FIGS. 9-12, a positive contact 82 and negative contact 84 are connected to battery 60 by electrical conductors (not shown) routed through attachment unit 62, and placed to contact matching terminals 86 and 88 in fans 22 and 24, when fans 22 and 24 are placed into inner mask 12. An on/off button 90 is placed into battery connection unit 62, so that fans 22 and 24 are only activated when properly positioned.

The battery unit 60 is a solid rectangle with dimensions about 70×70×30 mm, and is positioned in the front of the base mask 12 below the chin area (FIG. 1). The battery unit 60 contains rechargeable batteries, battery management circuits, and USB ports.

In use, fans 22 and 24 draw air in continuously, through filter 30, thereby relieving the user's lungs of the burden of providing all the suction to bring fresh air in through the filter 30. But the force of the in-breath plays a role and brings in air through the portions of filter 30 that are not immediately abutting fan 22 or fan 24. The in-breath will tend to press filter 30 against the intakes of fans 22 and 24, which together with pressure applied by filter cover 32 will be sufficient to prevent fans 22 and 24 from drawing air from inside filter 30, to ensure that air is drawn through filter 30. In one embodiment, however, adhesive is provided on the portions of fans 22 and 24 that abut filter 30 about the air intakes to ensure that air is drawn through filter 30.

In one embodiment fans 22 and 24 can each draw in a maximum of 3 cubic feet per minute, for a total of 6 cubic feet per minute. This would typically be enough, by itself, for a user at rest. But for a user engaged in vigorous activity, the air passing through portions of filter 30 that does not abut a fan, simply by the relative lower air pressure caused by the wearer's in-breath, is critical. In one embodiment, there are small filter circles that fit over the air intakes, and which can be changed more frequently then filter 30 (which does not cover the filters, in this embodiment) as the filter material 50 will tend to get dirty and clogged at the inputs of the fans 22 and 24 as more air is drawn through in this region. On the out breath, air is released through exhale valve 34.

In total the preferred modes have the advantages of providing a filter mask with fan assist, without blowing air into the face of a user, thereby permitting greater wear comfort. Also, providing a fan-assist to breathing through a filter, but permitting the user to help draw breath through the filter, with his in-breath, thereby easily accommodating different demands for incoming filtered air, without a complex fan adjustment mechanism. The exhale valve design is compact yet provides a high volume of exhale air. The fans may be removed from the assembly in the event they are not needed, thereby providing a lighter filter mask assembly. The battery is positioned on the bottom wall, where it will not obstruct the vision of the wearer, and can supply over 1 hour of electric power. If user prefers large battery, a USB cable can connect the large power bank with the face mask. Placing the exhale valve in the filter avoids cross contamination if the mask is switched from one user to another, as does the easy removability of fans 22 and 24, which may be switched out if the mask is being given to a new user. Further, mask liners 26 provide wearer comfort and are made in a variety of shapes to help fit persons having differing facial shapes.

Material, Process and Assembly

In a preferred embodiment, base mask 12 and cover 34 are made of medical grade polymer, more specifically a polycarbonate.

INDUSTRIAL APPLICABILITY

The present invention finds industrial applicability in the manufacture and supply of particulate filtering masks.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A particulate filtering mask assembly configured to be placed over the nose and mouth of the face of a wearer and defining an inside space between said mask and said wearer and an outside space, separated by said mask from said inside space, and comprising:

(a) a base mask, defining a set of openings;

(b) a filter, detachably supported by said base mask and covering said openings and including an air exit valve positioned over one of said openings of said base mask and which releases air from said inside space to said outside space when pressure in said inside space is greater than air pressure in said outside space;

(c) a source of electricity;

(d) a centrifugal fan, electrically connected to said source of electricity and positioned in another one of said openings of said base mask so as to draw air through said filter to said inside space and blowing air into said inside space in a direction that misses said wearer's face.

2. The mask assembly of claim 1, further including an additional centrifugal fan positioned in an additional one of said openings of said base mask so as to draw air through said filter from said outside space to said inside space and blowing air into said inside space in another direction that misses said wearer's face.

3. The mask assembly of claim 2, wherein said base mask has an open side facing said wearer's face, a bottom wall and a curved front wall defining the two centrifugal fan openings into which are fit said centrifugal fans.

4. The mask assembly of claim 3, further including a battery port on said bottom wall.

5. The mask assembly of claim 2, wherein said centrifugal fans are removable and include fan electrical contacts and wherein the base mask includes mask electrical connectors from said source of electricity that terminate in mask electrical contacts, and said mask electrical contacts are arranged to contact said fan electrical contacts when said centrifugal fans are fit into said centrifugal fan openings.

6. The mask assembly of claim 3, wherein said base mask further has a top curved edge, and wherein said centrifugal fans blow air toward said top curved edge.

7. The mask assembly of claim 1, wherein an air permeable mask cover is fit over said filter and acts to retain said filter in abutment to said base mask.

8. A kit including the mask assembly of claim 1, further including an additional filter, having different filtering characteristics from said filter of claim 1, and which is held in reserve for possible replacement of said filter.

9. The mask assembly of claim 1, wherein said set of openings includes openings not filled with the centrifugal fan or aligned to said air exit valve, thereby permitting said wearer to draw air by the in-breath, in addition to air supplied by said centrifugal fan.

* * * * *